US009532133B2

(12) United States Patent
Huang et al.

(10) Patent No.: US 9,532,133 B2
(45) Date of Patent: Dec. 27, 2016

(54) DUAL-FREQUENCY COAXIAL EARPHONE

(71) Applicant: Jetvox Acoustic Corp., Taoyuan (TW)

(72) Inventors: Ying-Shin Huang, Taoyuan (TW); To-Teng Huang, Taoyuan (TW)

(73) Assignee: JETVOX ACOUSTIC CORP., Taoyuan (TW)

( * ) Notice: Subject to any disclaimer, the term of this patent is extended or adjusted under 35 U.S.C. 154(b) by 75 days.

(21) Appl. No.: 14/604,507

(22) Filed: Jan. 23, 2015

(65) Prior Publication Data

US 2016/0044405 A1 Feb. 11, 2016

(30) Foreign Application Priority Data

Aug. 6, 2014 (TW) ..... 103214011 U

(51) Int. Cl.

| | |
|---|---|
| ***H04R 1/32*** | (2006.01) |
| ***H04R 1/10*** | (2006.01) |
| ***H04R 1/24*** | (2006.01) |
| ***H04R 1/26*** | (2006.01) |
| *H04R 1/02* | (2006.01) |
| *H04R 9/06* | (2006.01) |
| *H04R 11/02* | (2006.01) |

(52) U.S. Cl.

CPC *H04R 1/32* (2013.01); *H04R 1/10* (2013.01); *H04R 1/1075* (2013.01); *H04R 1/24* (2013.01); *H04R 1/26* (2013.01); *H04R 1/02* (2013.01); *H04R 9/06* (2013.01); *H04R 11/02* (2013.01)

(58) Field of Classification Search

CPC ..... H04R 1/32; H04R 1/10; H04R 1/1075; H04R 1/24; H04R 1/26; H04R 1/02; H04R 9/06; H04R 11/02; H04R 1/1058; H04R 25/00; H04R 25/02; H04R 25/405

USPC ..... 381/74, 182, 370, 380, 186

See application file for complete search history.

(56) References Cited

U.S. PATENT DOCUMENTS

| | | | | |
|---|---|---|---|---|
| 8,280,094 | B2 * | 10/2012 | Lehdorfer | H04R 1/1075 381/328 |
| 8,755,558 | B2 * | 6/2014 | Saiki | H04R 9/063 181/171 |
| 9,055,366 | B2 * | 6/2015 | Azmi | H04R 1/1075 |
| 9,258,630 | B2 * | 2/2016 | Chu | H04R 9/025 |

(Continued)

FOREIGN PATENT DOCUMENTS

| | | |
|---|---|---|
| EP | 2 549 776 A1 | 1/2013 |
| EP | 2 744 22 A2 | 6/2014 |

(Continued)

*Primary Examiner* — Vivian Chin
*Assistant Examiner* — Jason R Kurr
(74) *Attorney, Agent, or Firm* — Muncy, Geissler, Olds & Lowe, P.C.

(57) ABSTRACT

A dual-frequency coaxial earphone includes a dynamic transducer, a cover and a second transducer. The dynamic transducer includes a supporting structure and a vibrating diaphragm mounted to the supporting structure. The cover covers on the supporting structure, so that the cover and the supporting structure define a sound adjusting chamber therein. The cover includes an adjusting orifice communicating with the sound adjusting chamber. The second transducer is adapted to the cover and the second transducer has a first side facing toward the sound adjusting chamber. The sound adjusting chamber is located between the vibrating diaphragm and the second transducer.

8 Claims, 7 Drawing Sheets

(56) References Cited

U.S. PATENT DOCUMENTS

| | | | | |
|---|---|---|---|---|
| 9,332,336 | B2 * | 5/2016 | Fukushima | H04R 1/1058 |
| 9,369,791 | B2 * | 6/2016 | Tanaka | H04R 1/1016 |
| 2008/0240486 | A1 * | 10/2008 | Garcia | H04R 1/1016<br>381/380 |
| 2012/0087532 | A1 | 4/2012 | Yang | |
| 2013/0010998 | A1 * | 1/2013 | Seo | H04R 1/1058<br>381/380 |

FOREIGN PATENT DOCUMENTS

| | | | |
|---|---|---|---|
| JP | S 63-200988 | | 12/1988 |
| JP | 2516904 | B2 | 7/1996 |
| KR | 101236082 | B1 | 2/2013 |

* cited by examiner

1

1

DUAL-FREQUENCY COAXIAL EARPHONE

CROSS-REFERENCES TO RELATED APPLICATIONS

This non-provisional application claims priority under 35 U.S.C. §119(a) on Patent Application No. 103214011 filed in Taiwan, R.O.C. on 2014, Aug. 6, the entire contents of which are hereby incorporated by reference.

BACKGROUND

Technical Field

The instant disclosure relates to an earphone, and more particular to a dual-frequency earphone.

Related Art

As shown in FIG. 1, a conventional earphone casing A10 has a signal cable A1, a vibrating diaphragm A2, a permanent magnet A3, a voice coil A4, a magnet conductive member A5 and a yoke A6 assembled therein. The voice coil A4 is assembled on the vibrating diaphragm A2 and encloses a periphery of the permanent magnet A3. A gap is defined between the voice coil A4 and the magnet conductive member A5. The permanent magnet A3 is sandwiched between the magnet conducting member A5 and the yoke A6.

The signal cable A1 is connected electrically to the voice coil A4. When acoustic signals are inputted to the voice coil A4 via the signal cable A1, firstly the voice coil A4 generates a magnet field because of the electromagnetic effect. And then, the magnet field is interacted with the magnet conductive member A5 via magnetic forces so as to drive the vibrating diaphragm A2 to vibrate, so that the acoustic signals are converted to acoustic waves for output.

As in the conventional earphone A, generally the acoustic signals includes high frequency acoustic signals and low frequency acoustic signals, so both the high frequency acoustic waves and the low frequency acoustic waves will be generated when the vibrating diaphragm A2 vibrates. However, since the high frequency acoustic waves and the low frequency acoustic waves have different wavelengths and amplitudes, the characters of the two different acoustic waves cannot be distinguished by only one vibrating diaphragm A2, so that in a conventional earphone A, the high frequency acoustic waves and the low frequency acoustic waves have intermodulation distortion drawbacks thereby the voices cannot be performed in a clear manner. Furthermore, since the conventional earphone A is devoid of a structure for adjusting the frequency bands of the high and low frequency acoustic waves, the frequency band of the low frequency acoustic waves of the conventional earphone A cannot be adjusted according to user requirements, and the conventional earphone A can hardly output clear and high-quality high frequency voices.

SUMMARY

In view of this, the instant disclosure provides a dual-frequency coaxial earphone comprising a dynamic transducer, a cover and a second transducer. The dynamic transducer comprising a supporting structure and a vibrating diaphragm mounted to the supporting structure. The cover covers on the supporting structure, so that the cover and the supporting structure define a sound adjusting chamber therein. The cover comprises at least one sound adjusting orifice communicating with the sound adjusting chamber. The second transducer is adapted to the cover and has a first side facing toward the sound adjusting chamber. The sound adjusting chamber is located between the vibrating diaphragm and the second transducer.

In conclusion, since the second transducer is combinable with the cover, modulized production can be applied to the second transducer and the cover, so that the second transducer and the cover are combined with each other firstly, and then assembled to the dynamic transducer to be a semi-manufacture. Thereafter, the semi-manufacture is assembled with the housing to accomplish the production of the dual-frequency coaxial earphone, enabling the time for manufacturing to be reduced. Furthermore, the diameter of the sound adjusting orifice and the volume of the sound adjusting chamber can be tuned according to user requirements so as to provide different frequency bands for the user. The vibrating diaphragm of the dynamic transducer vibrates to generate low frequency sound, and then the low frequency sound are output to the sound output space through the at least one sound adjusting orifice of the sound adjusting chamber, so that the frequency of the low frequency sound are further adjusted according to the volume of the sound adjusting chamber and the size of the sound adjusting orifice. The second transducer generates high frequency sound delivered to the sound output space. Therefore, the sound adjusting chamber and the at least one sound adjusting orifice are provided to adjust the frequency bands of the low frequency sound, and then the adjusted low frequency sound are mixed with the high frequency sound at the sound output space to be output eventually. Thereby, high quality and clear medium frequency to high frequency sound with enlarged frequency bands can be provided to the user. In addition, the shape or the number of the sound adjusting orifice can be changed to control the sound volumes to be output. Besides, the cover further comprises at least one acoustic damper segment attached to the at least one sound adjusting orifice to damp the airflow passing through the sound adjusting orifice, thereby changing the sound volume output by the at least one sound adjusting orifice.

Detailed description of the characteristics and the advantages of the instant disclosure is shown in the following embodiments, the technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
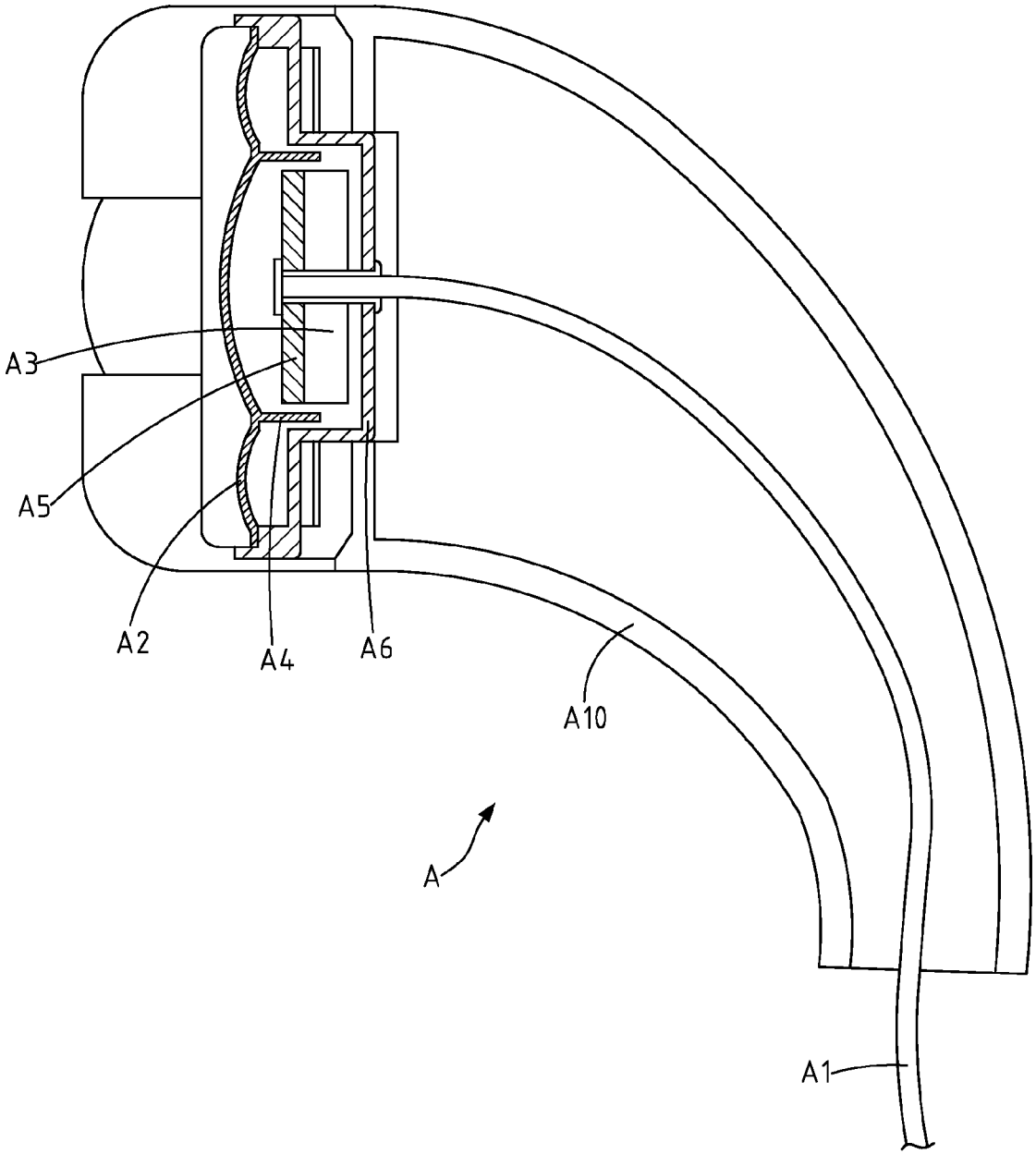
Fig. 1(Prior art)
FIG. 1 is a sectional view of a conventional earphone.
Figure 2:
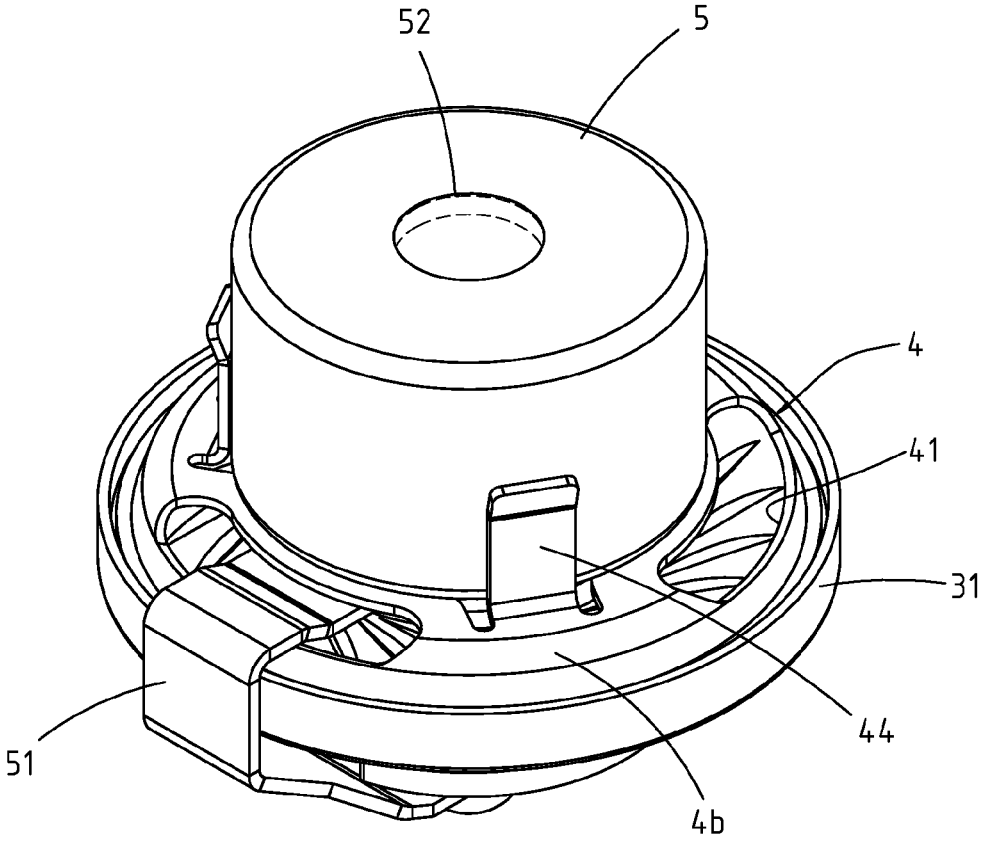
FIG. 2 is a perspective view of a first embodiment of a dual-frequency coaxial earphone according to the instant disclosure.
Figure 3:
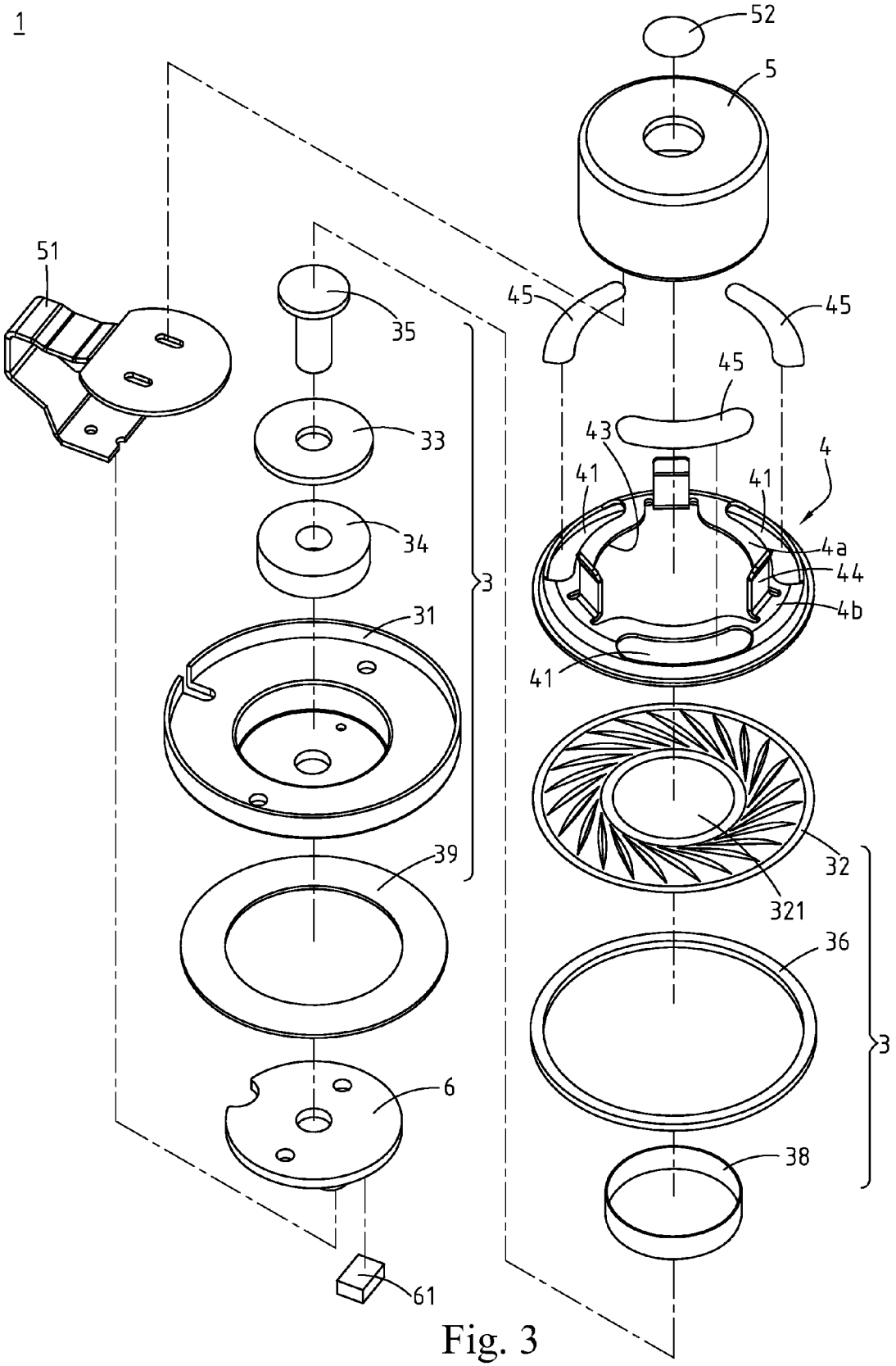
FIG. 3 is an exploded view of the first embodiment of the dual-frequency coaxial earphone according to the instant disclosure.
Figure 4:
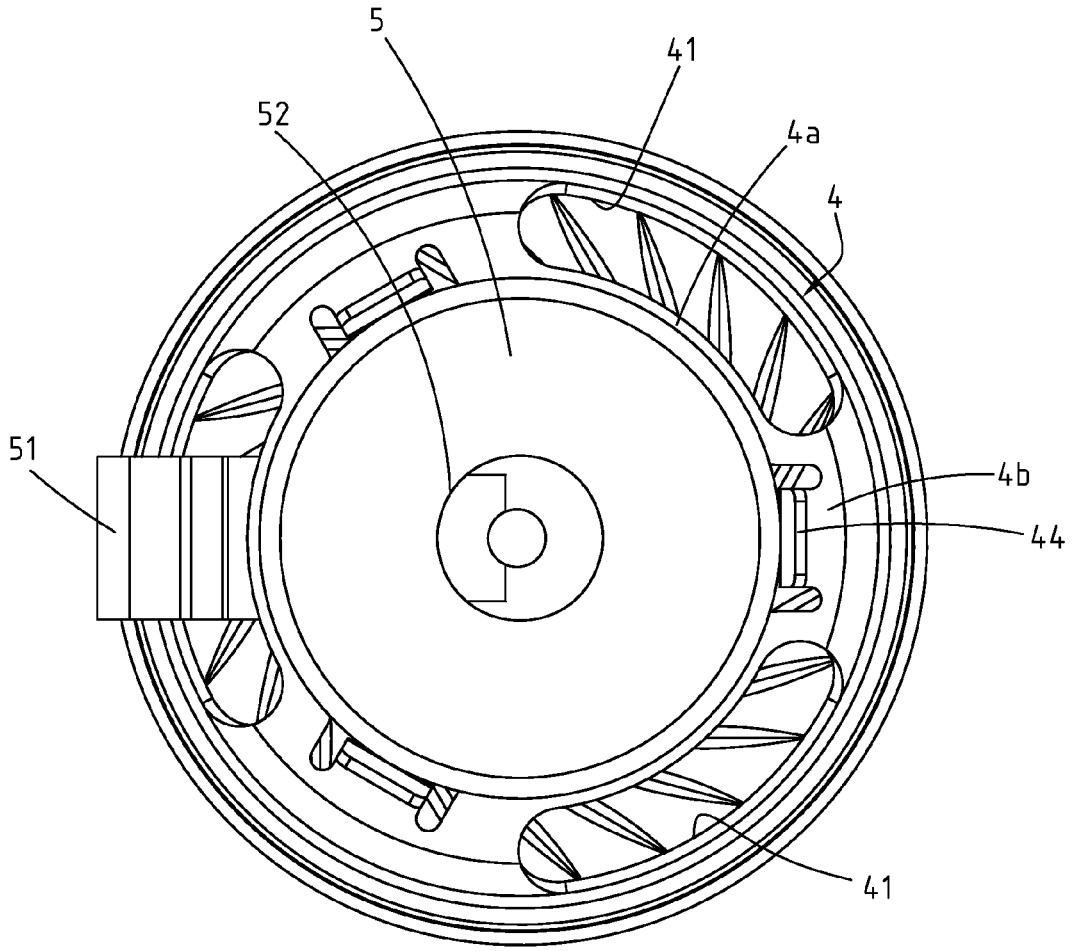
FIG. 4 is a top view of the first embodiment of the dual-frequency coaxial earphone according to the instant disclosure.
Figure 5:
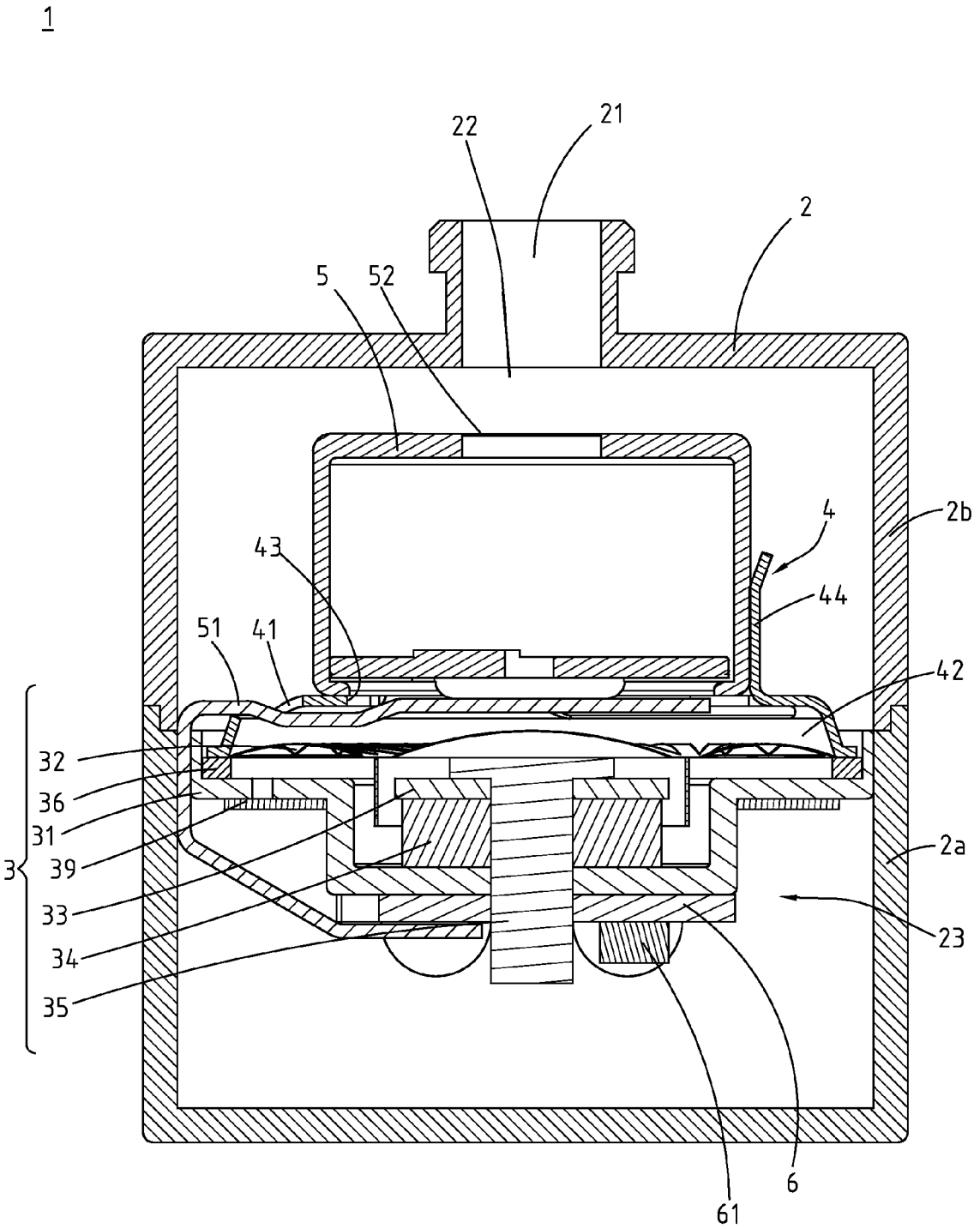
FIG. 5 is a sectional view of the first embodiment of the dual-frequency coaxial earphone according to the instant disclosure.

Please refer to FIG. 2, FIG. 3, FIG. 4 as long as FIG. 5, illustrating a first embodiment of a dual-frequency coaxial earphone 1 according to the instant disclosure. FIG. 2, FIG. 3, FIG. 4 and FIG. 5, respectively, are a perspective view, an exploded view, a top view and a sectional view, of the first embodiment of the dual-frequency coaxial earphone 1 according to the instant disclosure. In this embodiment, the dual-frequency coaxial earphone 1 comprises a housing 2, a dynamic transducer 3, a cover 4 and a second transducer 5. The sound frequency outputted by the second transducer 5 is higher than the sound frequency outputted by the dynamic transducer 3. In other words, the dynamic transducer 3 is a woofer and the second transducer 5 is a tweeter.

Please refer to FIG. 3 and FIG. 5, in which the housing 2 can be a unitary member or a multi-pieces member. In this embodiment, taking the housing 2 as a multi-pieces member, the housing 2 comprises a base 2*a* and a cap 2*b*, and the base 2*a* combines with the cap 2*b* to form the housing 2. The cap 2*b* has a sound output space 21 and a first receiving space 22, the sound output space 21 is located at a position of the cap 2*b* distant from the base 2*a*. The first receiving space 22 communicates with the sound output space 21. In this embodiment, the base 2*a* has a second receiving space 23. Components (such as a supporting structure 31, a rivet 32 and a fastening ring 36) and proper airtight seal techniques, like glue sealing, are provided to prevent the air convention between the second receiving space 23 and the sound output space 21 along with the first receiving space 22. That is, the first receiving space 22 and the second receiving space 23 are not air communicatable with each other.

Please further refer to FIG. 3 and FIG. 5, in which the dynamic transducer 3 is installed in the first receiving space 22. The dynamic transducer 3 comprises the supporting structure 31 and a vibrating diaphragm 32. The vibrating diaphragm 32 is mounted to the supporting structure 31 and comprises a central vibrating portion 321 faced toward the sound output space 21.

Please refer to FIGS. 3-5, in which the cover 4 is a dish-like structure. the cover 4 comprises a top plate 4*a* and a lateral plate 4*b* connected with each other. from a sectional view of the cover 4, the top plate 4*a* and the lateral plate 4*b* form a reversed U profile. The cover 4 is installed in the first receiving space 22. The opening of the U profiled cover is faced toward the dynamic transducer 3. The cover 4 is covered on the supporting structure 31, so that the cover 4 and the supporting structure 31 define a sound adjusting chamber 42 therein.

Figure 7:
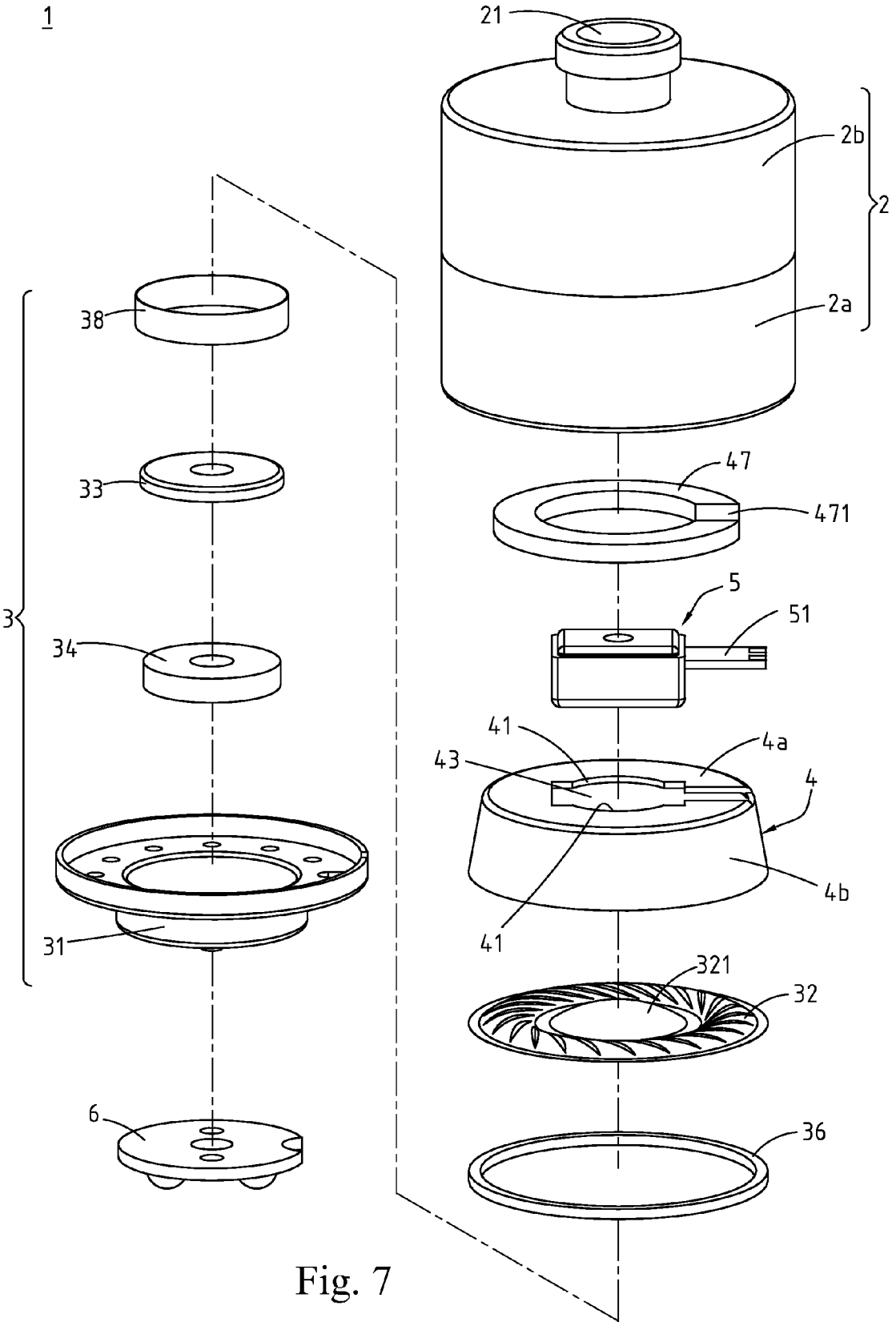
FIG. 7 is an exploded view of the second embodiment of the dual-frequency coaxial earphone according to the instant disclosure.

In this embodiment, the cover 5 comprises three sound adjusting orifices 41 arranged equiangular around the cover 4, but embodiments are not limited thereto. In some implementation aspects, the cover 4 comprises one sound adjusting orifice 41 (for example, any two of the three sound adjusting orifices 41 shown in FIG. 3 are omitted). In some implementation aspects, the cover 4 comprises two sound adjusting orifices 41 (as shown in FIG. 7). Here, taking the cover 4 having three sound adjusting orifices 41 as an example, the three centers of the three sound adjusting orifices 41 form an equilateral triangle in which the angle between a first connection line between a first sound adjusting orifice 41 and a second sound adjusting orifice 41 and a second connection line between a third sound adjusting orifice 41 and the first sound adjusting orifice 41, is 60 degrees. In other words, the three sound adjusting orifices 41 are arranged around the cover 4 by an angle of 120 degrees. While taking the cover 4 having two sound adjusting orifices 41 as an example, the two sound adjusting orifices 41 are arranged around the cover 4 and opposite to each other, so that the connection line between the two centers of the two sound adjusting orifices 41 is substantially passing through a center of the cover 4, as shown in FIG. 7. In this embodiment, at least three sound adjusting orifices 41 are arranged between the top plate 4*a* and the lateral plate 4*b*. That is, the at least three sound adjusting orifices 41 are arranged around a periphery of the cover 4, but embodiments are not limited thereto. In some implementation aspects, the at least three sound adjusting orifices 41 are arranged around the top plate 4*a* of the cover 4 or the lateral plate 4*b* of the cover 4. Furthermore, the sound adjusting chamber 42 communicates with at least one sound adjusting orifice 41.

Please refer to FIG. 3 and FIG. 5, in which the second transducer 5 may be a balanced armature transducer or a piezoelectric transducer. Here, the second transducer 5 is a cylinder structure, but embodiments are not thus limited thereto. an opening is defined at a center portion of the top of the second transducer 5. The second transducer 5 is adapted to the top plate 4*a* of the cover 4. At least one sound adjusting orifice 41 is arranged at the top plate 4*a* and adjacent to the periphery of the second transducer 5. Moreover, one of two sides of the second transducer 5 is faced toward the sound adjusting chamber 42, and the other side of the second transducer 5 is faced toward the sound output space 21. Here, the second transducer 5 is adjacent to the sound output space 21, and the sound adjusting chamber 42 is located between the vibrating diaphragm 32 and the second transducer 5. In other words, the cover 4 is located between the dynamic transducer 3 and the second transducer 5, and the second transducer 5 are not received into the sound output space 21. An interval is defined between the inner wall of the cap 2*b* and the second transducer 5. Furthermore, centers of the second transducer 5, the central vibrating portion 321 and the sound output space 21 are substantially aligned along the same axle.

Please refer to FIG. 3 and FIG. 5, it is understood that, in this embodiment, the second transducer 5 is secured to a front portion of the dynamic transducer 3. That is, the second transducer 5 is arranged adjacent to the sound output space 21. Since the second transducer 5 is combinable with the cover 4, modulized production can be applied to the second transducer 5 and the cover 4, so that the second transducer 5 and the cover 4 are combined with each other firstly, and then assembled to the dynamic transducer 3 to be a semi-manufacture. Thereafter, the semi-manufacture is assembled with the housing 2 to accomplish the production of the dual-frequency coaxial earphone 1 according to the instant disclosure, so that the time for manufacturing the dual-frequency coaxial earphone 1 according to the instant disclosure can be reduced.

Please refer to FIG. 3 and FIG. 4. The size of the sound adjusting orifice 41 and that of the sound adjusting chamber 42 can be tuned according to user requirements, under the modulized production process. That is, the diameter of the sound adjusting orifice 41 can be changed according to user requirements so as to deliver different sound volumes. Furthermore, the volume of the sound adjusting chamber 42 can also be tuned according to user requirements so as to provide different frequency bands for the user.

Please refer to FIG. 3 and FIG. 4. The descriptions about tuning the size of the sound adjusting orifice 41 is merely an illustrative example, but embodiments are not limited thereto. In some implementation aspects, the shape or the number of the sound adjusting orifice 41 can be changed so as to control the sound volumes to be output. Furthermore, in some implementation aspects, the cover 4 further comprises at least one acoustic damper segment 45 attached to the at least one sound adjusting orifice 41. In such embodiment, the acoustic damper segment 45 is provided to damp the airflow passing through the sound adjusting orifice 41. That is, the sound volume output by the at least one sound adjusting orifice 41 can be changed through the at least one acoustic damper segment 45.

Here, the vibrating diaphragm 32 of the dynamic transducer 3 vibrates to generate low frequency sound. And then, the low frequency sound are output to the sound output space 21 through the at least one sound adjusting orifice 41 of the sound adjusting chamber 42. The frequency of the low frequency sound outputted from the vibrating diaphragm 32 of the dynamic transducer 3 is related to the volume of the sound adjusting chamber 42 and the size of the sound adjusting orifice 41. The second transducer 5 generates high frequency sound delivered to the sound output space 21. Accordingly, the sound adjusting chamber 42 and the at least one sound adjusting orifice 41 are provided to adjust the frequency bands of the low frequency sound output from the vibrating diaphragm 32 of the dynamic transducer 3. And then, the adjusted low frequency sound are mixed with the high frequency sound from the second transducer 5 at the sound output space 21 to be output eventually. Furthermore, because the second transducer 5 is devoid of a via hole passing through the center thereof for delivering the low frequency sound to the sound output space 21, the low frequency sound are delivered to the first receiving space 22 via the at least one sound adjusting orifice 41, and are then delivered to the sound output space 21. That is, the low frequency sound output by the dynamic transducer 3 is delivered to the sound output space 21 through the gap between the second transducer 5 and the cap 2*b*. Furthermore, the second transducer 5 is adjacent to the sound output space 21 and closed to the ear of the user. Thus, when the user wears the dual-frequency coaxial earphone 1 according to the instant disclosure, the tympanic membrane of the ear of the user is near to the second transducer 5 to allow the high frequency sound (short waves) output by the second transducer 5 delivering to the tympanic membrane of the ear of the user. In other words, the high frequency sound of the second transducer 5 are allowed to output at a position near to the tympanic membrane. Because a small space is defined between the second transducer 5 and the tympanic membrane, high quality and clear medium frequency to high frequency sound can be provided to the user. Furthermore, in some implementation aspects, a second acoustic damper segment 52 is attached on the second transducer 5, as shown in FIG. 2. In addition, the second acoustic damper segment 52 and the second transducer 5 can be manufactured integrally, so that the second acoustic damper segment 52 can adjust the sound volumes output by the second transducer 5 and provide functions of sound adjustment and dustproof.

Please refer to FIG. 3 and FIG. 4, in some implementation aspects, the cover 4 further comprises a central through hole 43, the second transducer 5 is aligned with the central through hole 43, and at least one of the sound adjusting orifice 41 is adjacent to a periphery of the central through hole 43. Moreover, the cover 4 comprises at least two clamping plates 44, and the second transducer 5 is fastened by the at least two clamping plates 44. In detail, the at least two clamping plates 44 fasten the second transducer 5 by limiting the periphery of the second transducer 5. The at least two clamping plates 44 may be formed by breaching the top plate 4*a* firstly and then followed with bending two parts of the top plate 4*a* upwardly. For instance, the at least two clamping plates 44 may be formed by bending two parts of the top plate 4*a* corresponding to an inner wall of the central through hole 43, upward. Alternatively, the at least two clamping plates 44 may be formed by bending two parts of the top plate 4*a* corresponding to inner walls of at least two sound adjusting orifices 41, upwardly. Furthermore, the bottom of the second transducer 5 is secured atop the cover 4. Alternatively, the second transducer 5 is passing through the central through hole 43, and the bottom of the second transducer 5 is extended toward the sound adjusting chamber 42.

Please refer to FIG. 3 and FIG. 5, in some implementation aspects, the second transducer 5 further comprises a signal transmitting bracket 51 extended from one of the at least one sound adjusting orifice 41 to connect to the dynamic transducer 3. That is, the signal transmitting bracket 51 is connected between the dynamic transducer 3 and the second transducer 5. Moreover, one of two ends of the signal transmitting bracket 51 is connected to the dynamic transducer 3. In addition, a circuit board 6 is adapted to the supporting structure 31 of the dynamic transducer 3, and the circuit board 6 has a frequency divider circuit 61. The other end of the signal transmitting bracket 51 is connected to the circuit board 6 for dividing the mixed input signals from the signal transmitting bracket 51 into high frequency output signals for the second transducer 5 and low frequency output signals for the dynamic transducer 3. In this embodiment, the circuit board 6 has three soldering points, namely, three signal source connections. The mixed input signals are processed by the frequency divider circuit 61 and divided into low and high frequency output signals for the dynamic transducer 3 and the second transducer 5, respectively. In other words, high and low frequency sound are oriented from the same sound signal source, and the sound signal source is then divided into two independent sound (namely, the high frequency output signals and the low frequency output signals), by the frequency divider circuit 61 for the dynamic transducer 3 and the second transducer 5, respectively.

Please refer to FIG. 3 and FIG. 5, in some implementation aspects, the dynamic transducer 3 further comprises a magnet conductive plate 33, an annular magnet 34, the rivet 35, the fastening ring 36, a dynamic voice coil 38 and an acoustic impedance material 39. The annular magnet 34 is configured to the supporting structure 31, the magnet conductive plate 33 is placed at the top surface of the annular magnet 34, and the rivet 35 rivets the magnet conductive plate 33 with the annular magnet 34 and the supporting structure 31. Furthermore, centers of the rivet 35 and the annular magnet 34 are substantially aligned along the same axle. In addition, the fastening ring 36 is assembled on the supporting structure 31, the vibrating diaphragm 32 abut against the fastening ring 36, and the cover 4 abut against the vibrating diaphragm 32 to fasten the vibrating diaphragm 32. The dynamic voice coil 38 is assembled on the vibrating diaphragm 32 to enclose the magnetic conductive plate 33 therein. The periphery of the dynamic voice coil 38 is located on the supporting structure 31. The acoustic impedance material 39 is adapted to the periphery of the supporting structure 31. Here, the annular magnet 34 is installed in the dynamic voice coil 38, thus the dynamic transducer 3 is an inside magnetic trumpet, but embodiments are not thus limited thereto. In some implementation aspects, the annular magnet 34 is configured out of the dynamic voice coil 38, thus the dynamic transducer 3 is an outside magnet trumpet.

Figure 6:
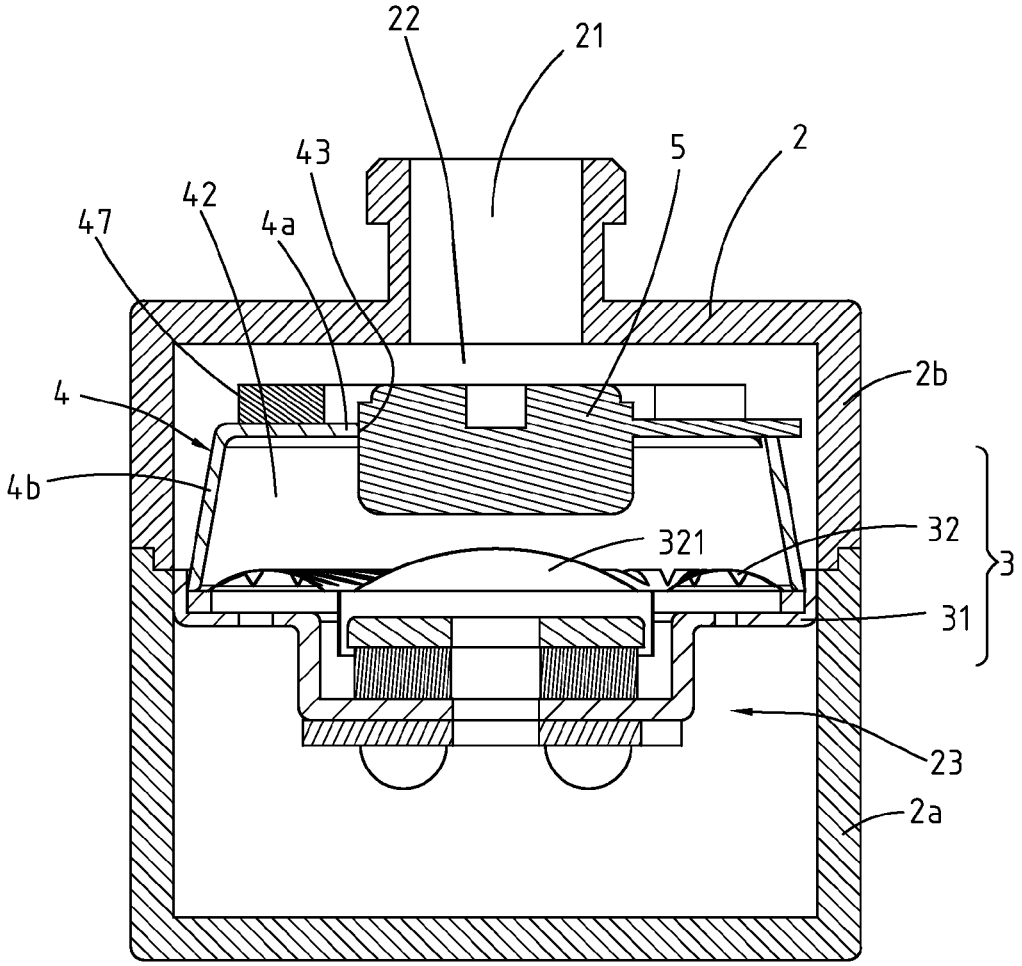
FIG. 6 is a sectional view of a second embodiment of a dual-frequency coaxial earphone according to the instant disclosure.

FIG. 6 is a sectional view of a second embodiment of a dual-frequency coaxial earphone 1 according to the instant disclosure, and FIG. 7 is an exploded view of the second embodiment of the dual-frequency coaxial earphone 1 according to the instant disclosure. Please refer to FIG. 6 and FIG. 7, in which the structure of the second embodiment is approximately the same as that of the first embodiment, except that in the second embodiment, at least two sound adjusting orifices 41 of the cover 4 communicate with the central through hole 43, and the second transducer 5 is rectangular shaped, so that after the second transducer 5 is installed in the central through hole 43, the at least two sound adjusting orifices 41 are respectively located at two sides of the second transducer 5. Here, the cover 4 having at least two sound adjusting orifices 41 is provided as an illustrative example, but embodiments are not limited thereto. In some implementation aspects, the cover 4 has one sound adjusting orifice 41. Furthermore, an abutting block 47 is assembled to the cover 4. The abutting block 47 is annular and abut against the cover 4. The periphery of the abutting block 47 defines a notch 471 for extending the signal transmitting bracket 51 of the second transducer 5. In this embodiment, the structure of the cover 4 is different from the cover 4 of the first embodiment. That is, the size of the at least one sound adjusting orifice 41 and the volume of the sound adjusting chamber 42 in the two embodiments are different from each other. accordingly, the size of the at least one sound adjusting orifice 41 and the volume of the sound adjusting chamber 42 can be tuned according to user requirements, under the modulized production process. Furthermore, in the second embodiment, similar to the first embodiment, an interval is defined between the second transducer 5 and the inner wall of the cap 2*b*, so that the sound output by the dynamic transducer 3 can be delivered to the sound output space 21 through the interval.

Based on the above, since the second transducer is combinable with the cover, modulized production can be applied to the second transducer and the cover, so that the second transducer and the cover are combined with each other firstly, and then assembled to the dynamic transducer to be a semi-manufacture. Thereafter, the semi-manufacture is assembled with the housing to accomplish the production of the dual-frequency coaxial earphone, enabling the time for manufacturing to be reduced. Furthermore, the diameter of the sound adjusting orifice and the volume of the sound adjusting chamber can be tuned according to user requirements so as to provide different frequency bands for the user. The vibrating diaphragm of the dynamic transducer vibrates to generate low frequency sound, and then the low frequency sound are output to the sound output space through the at least one sound adjusting orifice of the sound adjusting chamber, so that the frequency of the low frequency sound are further adjusted according to the volume of the sound adjusting chamber and the size of the sound adjusting orifice. The second transducer generates high frequency sound to deliver to the sound output space. Therefore, the sound adjusting chamber and the at least one sound adjusting orifice are provided to adjust the frequency bands of the low frequency sound, and then the adjusted low frequency sound are mixed with the high frequency sound at the sound output space to be output eventually. Thereby, high quality and clear medium frequency to high frequency sound with enlarged frequency bands can be provided to the user. In addition, the shape or the number of the sound adjusting orifice can be changed to control the sound volumes to be output. Besides, the cover further comprises at least one acoustic damper segment attached to the at least one sound adjusting orifice to damp the airflow passing through the sound adjusting orifice, thereby changing the sound volume output by the at least one sound adjusting orifice.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A dual-frequency coaxial earphone, comprising:

a dynamic transducer comprising a supporting structure and a vibrating diaphragm, the vibrating diaphragm mounted to the supporting structure and comprising a central vibrating portion;

a cover covering on the supporting structure, so that the cover and the supporting structure define a sound adjusting chamber therein, the cover comprising at least one sound adjusting orifice, a top plate, a central through hole, and at least two clamping plates, wherein the sound adjusting chamber communicates with the at least one sound adjusting orifice, the at least one sound adjusting orifice is arranged at a lateral side of the top plate of the cover, and the at least two clamping plates are formed by bending two parts of the top plate corresponding to an inner wall of the central through hole upward; and a second transducer adapted to the top plate of the cover, the second transducer having a first side facing toward the sound adjusting chamber, the sound adjusting chamber located between the vibrating diaphragm and the second transducer, wherein the second transducer is aligned with the central through hole, and the periphery of the second transducer is adjacent to the at least one sound adjusting orifice, and the second transducer is fastened by the at least two clamping plates.

2. The dual-frequency coaxial earphone according to claim 1, wherein the cover comprises at least two sound adjusting orifices, and the at least two sound adjusting orifices are arranged equiangular around the cover.

3. The dual-frequency coaxial earphone according to claim 1, wherein the cover comprises at least one acoustic damper segment attached to the at least one sound adjusting orifice.

4. The dual-frequency coaxial earphone according to claim 1, further comprising a shell, wherein the shell defines a receiving space and a sound output space communicating with the receiving space, wherein the dynamic transducer, the cover and the second transducer are installed in the receiving space, wherein the central vibrating portion is faced toward the sound output space, and a second side of the second transducer is faced toward the sound output space.

5. The dual-frequency coaxial earphone according to claim 1, wherein the second transducer comprises a signal transmitting bracket extended from the at least one sound adjusting orifice to connect to the dynamic transducer.

6. The dual-frequency coaxial earphone according to claim 1, wherein the dynamic transducer further comprises a magnet conductive plate, an annular magnet and a rivet, wherein the annular magnet is configured to the supporting structure, the magnet conductive plate is placed at the top surface of the annular magnet, and the rivet rivets the magnet conductive plate with the annular magnet and the supporting structure.

7. A dual-frequency coaxial earphone, comprising:

a dynamic transducer comprising a supporting structure and a vibrating diaphragm, the vibrating diaphragm mounted to the supporting structure and comprising a central vibrating portion;

a cover covering on the supporting structure, so that the cover and the supporting structure define a sound adjusting chamber therein, the cover comprising a top plate, at least one sound adjusting orifice, a central through hole, the sound adjusting chamber communicating with the at least one sound adjusting orifice, wherein the at least one sound adjusting orifice is arranged at a lateral side of the top plate of the cover, and the at least one sound adjusting orifice communicates with the central through hole; and a second transducer adapted to the top plate of the cover, the at least one sound adjusting orifice is arranged at the top plate and adjacent to a periphery of the second transducer, the second transducer having a first side facing toward the sound adjusting chamber, the sound adjusting chamber located between the vibrating diaphragm and the second transducer, wherein the second transducer is aligned with the central through hole, and the second transducer is passing through the central through hole and a bottom of the second transducer is extended toward the sound adjusting chamber.

8. The dual-frequency coaxial earphone according to claim 7, wherein the second transducer is a balanced armature transducer or a piezoelectric transducer.

* * * * *